US006574939B1

(12) United States Patent
Heijnen et al.

(10) Patent No.: US 6,574,939 B1
(45) Date of Patent: Jun. 10, 2003

(54) APPARATUS FOR PRODUCING RE-CLOSABLE BAG PACKAGES

(75) Inventors: Antwan Heijnen, Someren (NL); Peter Slenders, Maarheeze (NL); Mark Smeets, Weert (NL)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/700,407

(22) PCT Filed: Feb. 6, 1999

(86) PCT No.: PCT/DE99/00313

§ 371 (c)(1),
(2), (4) Date: Feb. 21, 2001

(87) PCT Pub. No.: WO99/59872

PCT Pub. Date: Nov. 25, 1999

(30) Foreign Application Priority Data

May 15, 1998 (DE) ..... 298 08 817 U

(51) Int. Cl.[7] ..... B65B 61/20; B65B 51/04; B65B 9/06

(52) U.S. Cl. ..... 53/133.4; 53/551; 53/139.2; 156/66; 493/214

(58) Field of Search ..... 53/133.4, 139.2, 53/551, 552, 412; 493/212, 213, 214, 927; 156/66

(56) References Cited

U.S. PATENT DOCUMENTS

| | | | | | |
|---|---|---|---|---|---|
| 2,294,220 | A | * | 8/1942 | Albertson | 383/108 |
| 4,241,563 | A | * | 12/1980 | Muller et al. | 53/511 |
| 4,617,683 | A | * | 10/1986 | Christoff | 383/35 |
| 5,753,067 | A | * | 5/1998 | Fukuda et al. | 156/358 |
| 5,816,018 | A | * | 10/1998 | Bois | 493/213 |
| 5,937,615 | A | * | 8/1999 | Forman | 493/213 |
| 5,971,905 | A | * | 10/1999 | Fukuda | 493/25 |

* cited by examiner

*Primary Examiner*—Rinaldi I. Rada
*Assistant Examiner*—Paul Durand
(74) *Attorney, Agent, or Firm*—Ronald E. Greigg

(57) ABSTRACT

An apparatus for producing re-closable bag packages has a device for delivering and securing a portion of a closure strip on a film web. To make greater output as well as continuous operation of the apparatus possible, it is proposed that the device be equipped with a horizontally movable securing device, which tacks the portions to a moving film web.

20 Claims, 3 Drawing Sheets

APPARATUS FOR PRODUCING RE-CLOSABLE BAG PACKAGES

CROSS-REFERENCE TO RELATED APPLICATIONS

This is a 35 USC 371 application of PCT/DE 00/00313 filed on Feb. 2, 1999.

PRIOR ART

The invention relates to an apparatus for producing re-closable bag packages of the kind that have become known for instance from European Patent Disclosure EP 0 410 126 A1. In this known apparatus, which operates intermittently, during the stopped phase of the film feeding, a closure strip portion is tacked to the flat top side of the film web. Next, a tube is shaped from the flat film web. In the forming of the transverse seams of the bag packages formed from the tube, the closure strip portion is at the same time sealed over its full surface to the inside of the tube. Because during the stopped phase of film feeding the closure strip portion must be delivered and attached, the output of the known apparatus is limited, since the cycling time depends on the time required to attach the closure strip portion. Furthermore, with the known apparatus a continuous mode of operation is not possible.

ADVANTAGES OF THE INVENTION

The apparatus according to the invention for producing re-closable bag packages has the advantage of making especially high output possible.

Further advantages and advantageous refinements of the apparatus according to the invention for producing re-closable bag packages will become apparent from the dependent claims and the description.

A further increase in output of the apparatus is possible if the apparatus is operated continuously.

A synchronous motion of the transverse seam sealing device and of the device for attaching and securing the closure strip can be achieved if the two devices are coupled to one another.

BRIEF DESCRIPTION OF THE DRAWINGS

One exemplary embodiment of the invention is shown in the drawing and explained in further detail in the ensuing description. Shown are.

DESCRIPTION OF THE EXEMPLARY EMBODIMENT

Figure 1:
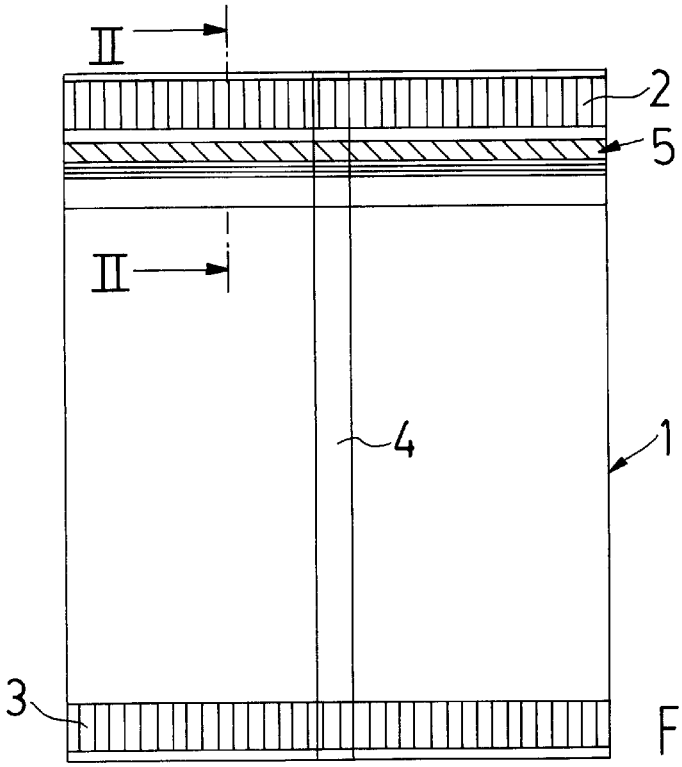
FIG. 1, a re-closable bag, in a front view.
Figure 2:
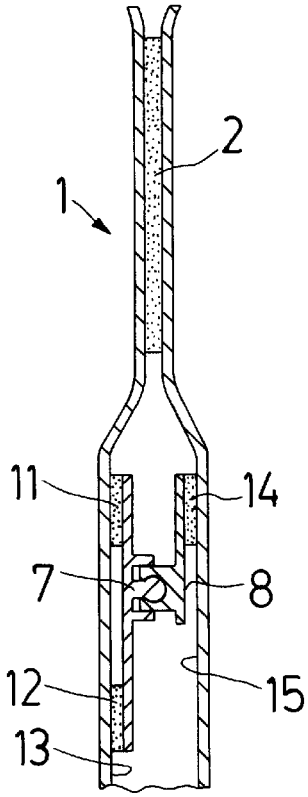
FIG. 2, a section taken along the line II—II of FIG. 1.

The bag package 1, known per se, shown in FIGS. 1 and 2 has an upper transverse seam 2, a lower transverse seam 3, and a longitudinal seam 4 extending centrally in a side face. A portion 5 of a re-closable strip 6 is disposed somewhat below the upper transverse seam 2. The strip 6 has two parts 7, 8, cooperating with one another by positive engagement; one part 7 is bonded by sealing in two regions 11, 12 to one inside 13, and the other part 8 is bonded by sealing with a region 14 to the opposed inside 15 of the bag package 1. To enable easy opening of the bag package 1 at its upper transverse seam 2, the upper transverse seam 2 is preferably embodied as a so-called peeling seam. An alternative to this would, however, also be to embody a weakening region between the upper transverse seam 2 and the strip 6, so that the corresponding upper portion of the bag package 1 can easily be torn open or torn off.

Figure 3:
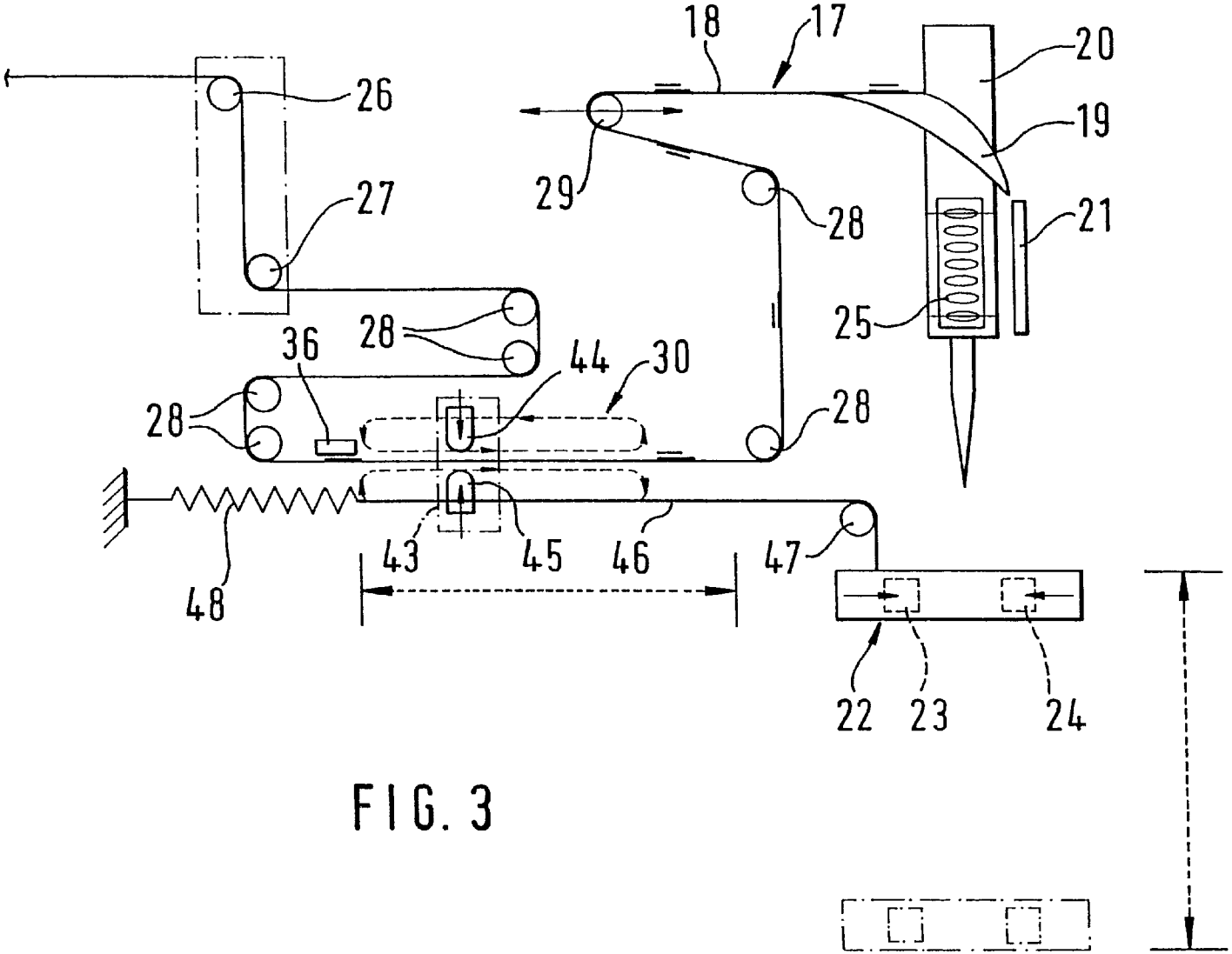
FIG. 3, an apparatus for producing re-closable bag packages in a schematic side view.
Figure 4:
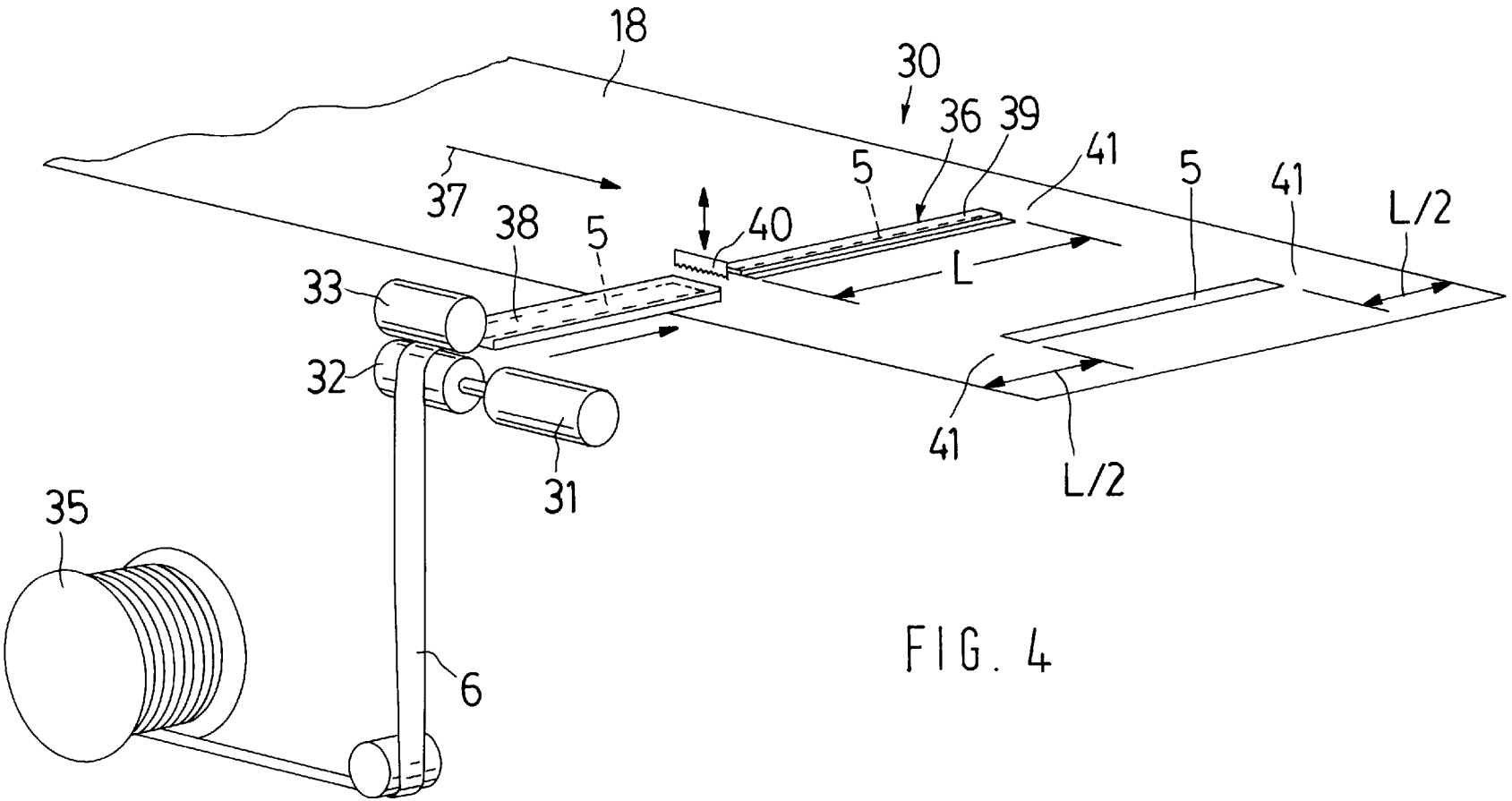
FIG. 4, a device for delivering and securing a closure strip portion to a flat film web, in a perspective view.

The production of this kind of bag package 1 is done on a vertical bag-making machine 17, schematically shown in FIGS. 3 and 4, that operates continuously. The bag-making machine 17, for forming the bag packages 1 from a web 18 of packaging material has a forming shoulder 19, which is connected in the usual way with a forming tube 20. Below the forming shoulder 19 on the forming tube 20, there is a longitudinal seam sealing device 21 for forming the longitudinal seam 4. Also located below the forming tube 20 is a transverse seam jaw housing 22, which can move up and down and has two transverse seam sealing jaws 23, 24 that can be moved toward one another. The transverse seam sealing jaws 23, 24 are used to form the transverse seams 2, 3, and at the same time the regions 11, 14 of the strip 6 are sealed over their full surface against the inside 13, 15 of the bag packages 1.

For delivering the web 18 of packaging material from a supply roll, not shown, not only the feed belts 25, which are in direct contact with the forming tube 20, but also continuously driven feed rollers 26, 27 and deflection rollers 28 are used. In addition, a horizontally movable delivery roller 29 is provided in the inlet region to the forming shoulder 19; it enables an adaptation in terms of format to various lengths of bag packages 1. For delivering and securing the strip 6 or the portions 5 on the web 18 of packaging material, the bag-making machine 17 has a special device 30.

The device 30, disposed in the region of a horizontal delivery path of the web 18 of packaging material, has a stationary pair of rollers 32, 33 that are driven by a stepping motor 31. The pair of rolling rollers 32, 33, disposed laterally and above the web 18 of packaging material, pulls off one corresponding portion 5 of the strip 6 from a supply roll 35 at a time, intermittently, in accordance with the width of the bags 1. The strip 6 drawn from the pair of rolling rollers 32, 33 is carried and oriented by a guide cassette 36 immediately above the web 18 of packaging material; the longitudinal direction of the strip 6 extends perpendicular to the web 18 of packaging material and to its feeding direction 37.

The guide cassette 36 comprises two elements 38, 39, between which a cutting device 40 is disposed for cutting off the portion 5 from the strip 6. The portion 5 is placed above the web 18 of packaging material in such a way that one region 41 of the web of packaging material, with a width of somewhat more than L/2 (depending on the shape of the bag), remains on each side of the portion 5. It is also essential that the element 39 is embodied such that the region 12 of the part 7 of the element 39 laterally protrudes on the side toward the forming shoulder 19.

On the side of the guide cassette 36 toward the forming shoulder 19, there is a securing device 43 for the portion 5. The securing device 43, which can be moved horizontally back and forth, has a sledlike construction, with one sealing jaw 44, 45, which can be moved up and down, each disposed below and above the web 18 of packaging material. In the horizontal terminal position toward the guide cassette 36, the two sealing jaws 44, 45 are made to coincide with the region 12 of the portion 5. The other horizontal terminal position is assumed upon conclusion of the sealing of the region 12 on the web 18 of packaging material.

To effect a synchronous horizontal motion of the two sealing jaws 44, 45 with the continuous feeding motion of the web 18 of packaging material, the securing device 43 is coupled to the transverse seam jaw housing 22. The coupling is done for instance by means of a toothed belt 46, which is guided over a deflection roller 47. The effect of the toothed belt 46 is that the sealing jaws 44, 45, upon a downward motion of the transverse seam sealing jaws 23, 24, which takes place at the feeding speed of the tube formed from the web 18 of packaging material, are brought at the same speed and synchronously from the terminal position oriented toward the guide cassette 36 to their other terminal position. Since the toothed belt 46 transmits only traction forces, the end of the securing device 43 opposite the toothed belt 46 is connected to a tension spring 48, which is capable of returning the securing device 43, and thus also the sealing jaws 44, 45, to the terminal position associated with the guide cassette 36.

The bag-making machine 17 described above functions as follows: The web 18 of packaging material, drawn off continuously from the feed rollers 26, 27, passes over the deflection rollers 28 and the delivery roller 29 to reach the forming shoulder 19. The forming shoulder 19 places the two peripheral regions 41 of the web of packaging material against one another, forming a tube; the regions 41 of the web of packaging material overlap in the region of the longitudinal seam 4. The overlapping region is sealed along the further feed path of the web 18 of packaging material to form the longitudinal seam 4. Below the forming tube 20, the transverse seam sealing jaws 23, 24 are moved toward one another when the transverse seam jaw housing 22 moves downward. Then the transverse seam jaw housing 22 is moved at the feeding speed of the tube, into its lower terminal position, and the formation of an upper transverse seam 2 for a first bag package 1, a lower transverse seam 3 for a second bag package 1, and the sealing of the regions 11, 14 of the portion 5 to the insides 13, 15 take place. During the downward-oriented motion of the transverse seam jaw housing, the product for filling the package is simultaneously dispensed, in a manner known per se through a filling tube, not shown, into the bag package 1, which is not yet closed at the top. As soon as the two transverse seams 3, 4 have been sealed, a filled bag package 1 is cut from the tube by a cutting device, also not shown. Next, the transverse seam sealing jaws 23, 24 are opened again, and the transverse seam jaw housing 22 is returned to its upper terminal position.

The application of the portions 5 of the strip 6 to the web 18 of packaging material is done in two steps: During the aforementioned up-and-down motion of the transverse seam jaw housing 22, one portion 5 of length L at a time is inserted by the stepping motor 31 into the element 39 of the guide cassette 36 and is severed from the strip 6 by the cutting device 40. What is essential is that the portion 5 is severed from the strip 6 when the securing device 43 is in its terminal position oriented toward the guide cassette 36. The two sealing jaws 44, 45 are now moved against the film web 18, causing the region 7 of the portion 5 to enter into direct contact with the sealing jaw 44 and the top side of the film web 18. This occurs immediately at the instant when the transverse seam jaw housing 22 has passed its upper turning point. In the ensuing downward motion of the transverse seam jaw housing 22, the securing device 43 is moved by the toothed belt 46 in the feeding direction 36, and the sealing jaws 44, 45, moved against one another, pulled the portion 5 out of the element 39 of the guide cassette 36. During this motion of the securing device 43, the region 7 of the portion 5 is sealed, under the influence of pressure and heat, to the top side of the web of packaging material. The sealing operation is terminated before reaching the lower returning point of the transverse seam jaw housing 22, whereupon the two sealing jaws 44, 45 are re-opened. In the ensuing upward motion of the transverse seam jaw housing 22, the securing device 43 is returned by the tension spring 48 to the terminal position oriented toward the guide cassette 36, whereupon the processes are repeated as described above.

The foregoing relates to a preferred exemplary embodiments of the invention, it being understood that other variants and embodiments thereof are possible within the spirit and scope of the invention, the latter being defined by the appended claims.

We claim:

1. An apparatus (17) for producing re-closable bag packages (1), having a device (30) for delivering and securing a portion (5) of a closure strip (6) on a film web (18), in which the delivery direction of the closure strip (6) and the feeding direction (37) of the film web (18) extend perpendicular to one another, having a forming device (19) for forming a tube from the film web (18) in such a way that the regions (41) of the film web disposed on both sides of the closure strip (6) are placed against one another, forming a longitudinal seam (4), and having a transverse seam sealing device (22) for forming a bottom transverse seam (3) and a top transverse seam (2) above the closure strip (6), wherein the device (30) for delivering and securing the closure strip (6) has a securing device (43) for securing the closure strip (6) to the film web (18), which securing device is moveable parallel to the feeding direction (37) of the film web while the apparatus is in operation (18).

2. The apparatus of claim 1, wherein a film feeding device (26, 27) is provided, which feeds the film web (18) continuously.

3. The apparatus of claim 2, wherein the transverse seam sealing device (22) is movable back and forth in the feeding direction of the tube formed from the film web (18), and that a connection (46) between the transverse seam sealing device (22) and the securing device (43) is provided, which transmits the motion of the transverse seam sealing device (22) to the securing device (43).

4. The apparatus of claim 2, wherein a horizontally movable delivery roller (29) for adaptation to various lengths of bag package is provided between the securing device (43) and the transverse seam sealing device (22).

5. The apparatus of claim 4, wherein the apparatus is a vertical bag-making machine (17).

6. The apparatus of claim 2, wherein the apparatus is a vertical bag-making machine (17).

7. The apparatus of claim 3, wherein spring means (48) are provided, which cooperate with the connection (46) and returns the securing device (43) to an original position after the connection (46) has moved the securing device (43) in its motion parallel to the direction of the web travel.

8. The apparatus of claim 1, wherein a horizontally movable delivery roller (29) for adaptation to various lengths of bag package is provided between the securing device (43) and the transverse seam sealing device (22).

9. The apparatus of claim 7, wherein the apparatus is a vertical bag-making machine (17).

10. The apparatus of claim 3, wherein a horizontally movable delivery roller (29) for adaptation to various lengths of bag package is provided between the securing device (43) and the transverse seam sealing device (22).

11. The apparatus of claim 3, wherein the apparatus is a vertical bag-making machine (17).

12. The apparatus of claim 1, wherein a horizontally movable delivery roller (29) for adaptation to various lengths of bag package is provided between the securing device (43) and the transverse seam sealing device (22).

13. The apparatus of claim 12, wherein the apparatus is a vertical bag-making machine (17).

14. The apparatus of claim 1 wherein the apparatus is a vertical bag-making machine (17).

15. An apparatus (17) for producing re-closable bag packages (1), having a device (30) for delivering and securing a portion (5) of a closure strip (6) on a film web (18), in which the delivery direction of the closure strip (6) and the feeding direction (37) of the film web (18) extend perpendicular to one another, having a forming device (19) for forming a tube from the film web (18) in such a way that the regions (41) of the film web disposed on both sides of the closure strip (6) are placed against one another, forming a longitudinal seam (4), and having a transverse seam sealing device (22) for forming a bottom transverse seam (3) and a top transverse seam (2) above the closure strip (6), wherein the device (30) for delivering and securing the closure strip (6) has a securing device (43) for securing the closure strip (6) to the film web (18), which securing device is moveable parallel to the feeding direction (37) of the film web while the apparatus is in operation (18), and wherein the transverse seam sealing device (22) is movable back and forth in the feeding direction of the tube formed from the film web (18), and that a connection (46) between the transverse seam sealing device (22) and the securing device (43) is provided, which transmits the motion of the transverse seam sealing device (22) to the securing device (43).

16. The apparatus of claim 15, wherein spring means (48) are provided, which cooperate with the connection (46) and returns the securing device (43) to an original position after the connection (46) has moved the securing device (43) in its motion parallel to the direction of the web travel.

17. The apparatus of claim 16, wherein a horizontally movable delivery roller (29) for adaptation to various lengths of bag package is provided between the securing device (43) and the transverse seam sealing device (22).

18. The apparatus of claim 16, wherein the apparatus is a vertical bag-making machine (17).

19. The apparatus of claim 15, wherein a horizontally movable delivery roller (29) for adaptation to various lengths of bag package is provided between the securing device (43) and the transverse seam sealing device (22).

20. The apparatus of claim 15, wherein the apparatus is a vertical bag-making machine (17).

* * * * *